US008205747B2

(12) United States Patent
Nazari

(10) Patent No.: US 8,205,747 B2
(45) **Date of Patent: *Jun. 26, 2012**

(54) DISPLAY PACK AND PACKAGING METHOD AND APPARATUS

(76) Inventor: Joseph Nazari, Glendale, CA (US)

( * ) Notice: Subject to any disclaimer, the term of this patent is extended or adjusted under 35 U.S.C. 154(b) by 94 days.

This patent is subject to a terminal disclaimer.

(21) Appl. No.: 12/790,747

(22) Filed: May 28, 2010

(65) Prior Publication Data

US 2010/0236963 A1 Sep. 23, 2010

Related U.S. Application Data

(63) Continuation of application No. 11/374,769, filed on Mar. 14, 2006, now Pat. No. 7,726,480.

(60) Provisional application No. 60/711,024, filed on Aug. 24, 2005.

(51) Int. Cl.
*B65D 81/24* (2006.01)

(52) U.S. Cl. ..... 206/461; 206/462

(58) Field of Classification Search ..... 206/461–471, 206/703, 705, 484, 531; 428/59, 182–184; 108/51.3

See application file for complete search history.

(56) References Cited

U.S. PATENT DOCUMENTS

| | | | |
|---|---|---|---|
| 2,884,127 | A | 4/1959 | Neary |
| 2,993,590 | A | 7/1961 | Denton |
| 3,062,366 | A | 11/1962 | Palmer |
| 3,195,284 | A | 7/1965 | Crane, Jr. |
| 3,203,542 | A | 8/1965 | Lightner et al. |
| 3,303,930 | A | 2/1967 | Hyland |
| 3,327,843 | A | 6/1967 | O'Meara et al. |
| 3,587,848 | A | 6/1971 | Froehlig |

(Continued)

FOREIGN PATENT DOCUMENTS

| | | | |
|---|---|---|---|
| CN | 1096980 | A | 1/1995 |

(Continued)

OTHER PUBLICATIONS

Request for Ex Parte Reexamination of USP 7726480, dated Jun. 1, 2010 by Robert M. DeWitty, Esq., a party other than the patent owner of USP 7726480, which is the issued patent of the parent application of the instant application, namely, U.S. Appl. No. 90/009,755, the Request including Transmittal Form (2 pages), Transmittal Letter (17 pages), and Certificate of Service (1 page).

(Continued)

*Primary Examiner* — J. Gregory Pickett
*Assistant Examiner* — Andrew Perreault
(74) *Attorney, Agent, or Firm* — Christie, Parker & Hale, LLP

(57) ABSTRACT

A display pack for a consumer product is made of two sheets of corrugated cardboard and a clear plastic container with a flat insertion portion sandwiched between the cardboard sheets. The two cardboard sheets are adhered together in a peripheral area of the package by a heat-sensitive adhesive, and the corrugations of the cardboard sheets are crushed and flattened in the peripheral area. To seal the package, the peripheral area of the two cardboard sheets is subject to sufficient pressure to crush the corrugations inside the cardboard sheets and flatten them in that area. Heat is applied to the outer side of the cardboard sheets in the peripheral area and conducted to the adhesive material between the two sheets to activate the adhesive material. A sealer machine with a heated sealing press or parallel sets of heated rollers may be used to carry out the sealing process.

20 Claims, 6 Drawing Sheets

U.S. PATENT DOCUMENTS

| | | | |
|---|---|---|---|
| 3,924,747 | A | 12/1975 | Gerner |
| 4,056,922 | A | 11/1977 | Schilte |
| 4,083,451 | A | 4/1978 | Hair |
| 4,261,462 | A | 4/1981 | Wysocki |
| 4,776,150 | A | 10/1988 | Siegel |
| 4,842,141 | A | 6/1989 | Segal |
| 4,981,213 | A | 1/1991 | Dillon |
| 5,131,539 | A | 7/1992 | Karita et al. |
| 5,522,505 | A | 6/1996 | Giovannone |
| 5,704,481 | A | 1/1998 | Lutz |
| 6,126,584 | A | 10/2000 | Zadravetz |
| 6,691,870 | B1 | 2/2004 | Palm et al. |
| 7,051,876 | B2 | 5/2006 | Grosskopf |
| 7,207,441 | B2 | 4/2007 | Ritter |
| 2003/0217949 | A1 | 11/2003 | Schamante |
| 2004/0251175 | A1 | 12/2004 | Adams et al. |
| 2006/0201843 | A1 | 9/2006 | Kellar et al. |
| 2008/0029417 | A1 | 2/2008 | Begim |

FOREIGN PATENT DOCUMENTS

| | | | |
|---|---|---|---|
| CN | 2269414 | Y | 12/1997 |
| EP | 0439728 | A2 | 8/1991 |
| FR | 2757489 | A1 | 6/1998 |
| GB | 695708 | A | 8/1953 |
| WO | WO 93/06009 | A1 | 4/1993 |

OTHER PUBLICATIONS

37 CFR 1.501 Information Disclosure Citation (1 page) dated Jun. 1, 2010, the Information Disclosure Citation including USP 7726480 (12 pages), Chinese Publication CN 1096980A (9 pages), and English translation (2 pages).

Notice of Failure to Comply dated Jun. 30, 2010 for Reexamination (6 pages).

Request for Ex Parte Reexamination dated USP 7726480, dated Jun. 10, 2010 by Robert M. DeWitty, Esq., in response to Notice of Failure to Comply, the Request including Transmittal Form (2 pages), Transmittal Letter (18 pages).

Ex Parte Reexamination Communication Transmittal Form (7 pages) dated Jul. 30, 2010, denying Request for Ex Parte Reexamination.

Supplementary European Search Report in counterpart application EP 06801817.5 dated Jun. 26, 2008. 6 Sheets.

International Search Report completed Apr. 16, 2007 for International Application PCT/US2006/32274, 3 sheets.

European Search Report completed Jan. 13, 2011 for European Application 10013746.2, 4 Sheets.

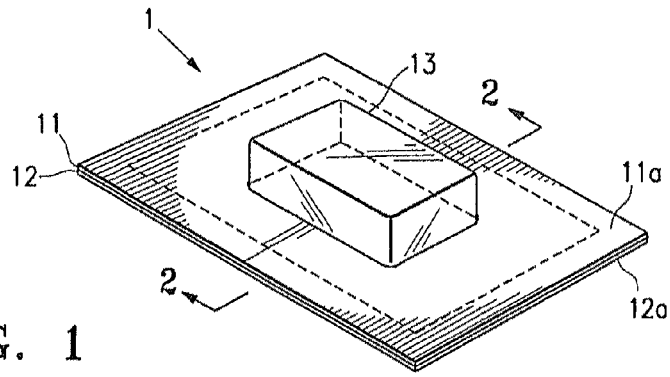
FIG. 1
FIG. 2(a)
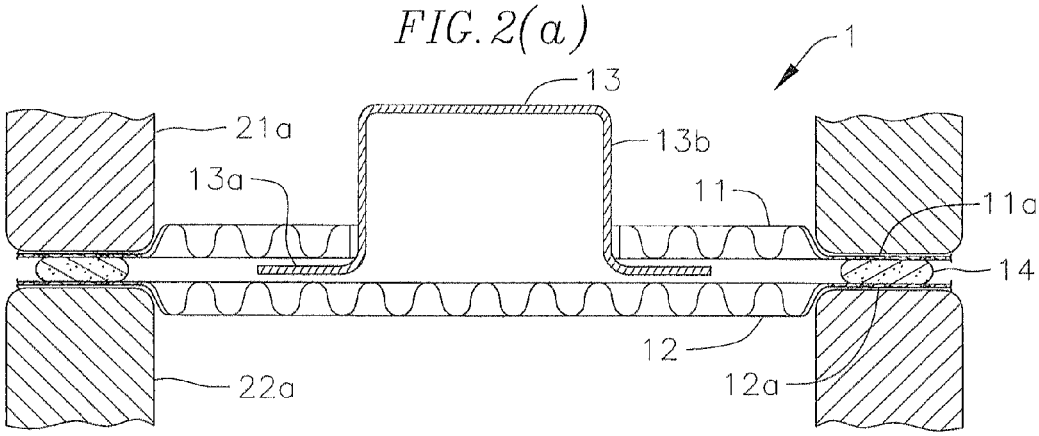
FIG. 2(b)
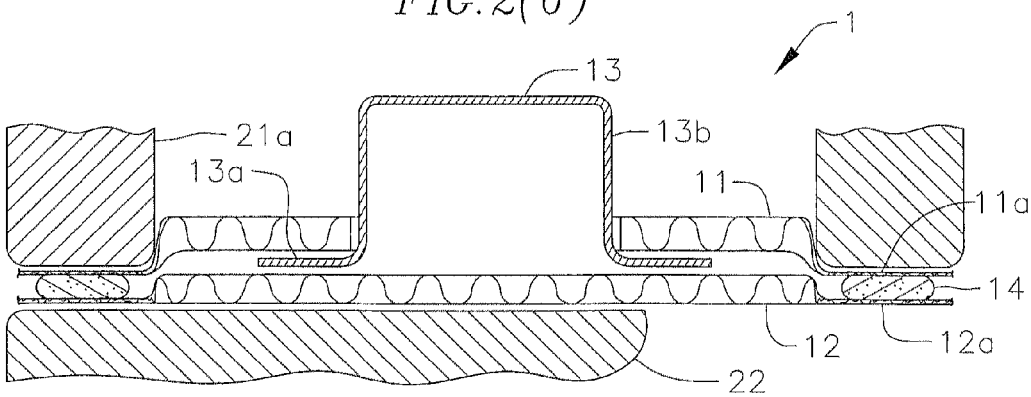

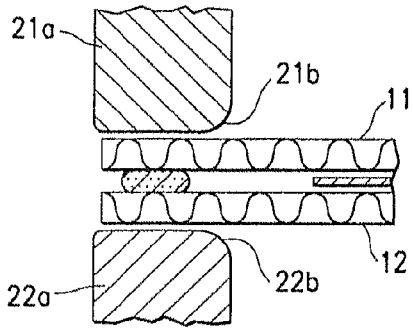
FIG. 4(a)
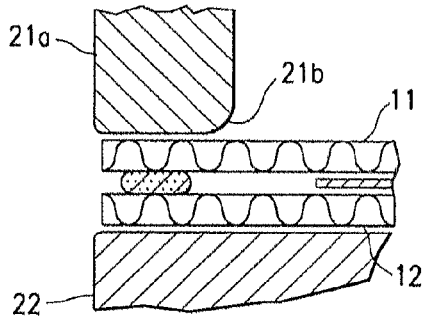
FIG. 4(b)
FIG.5(a)
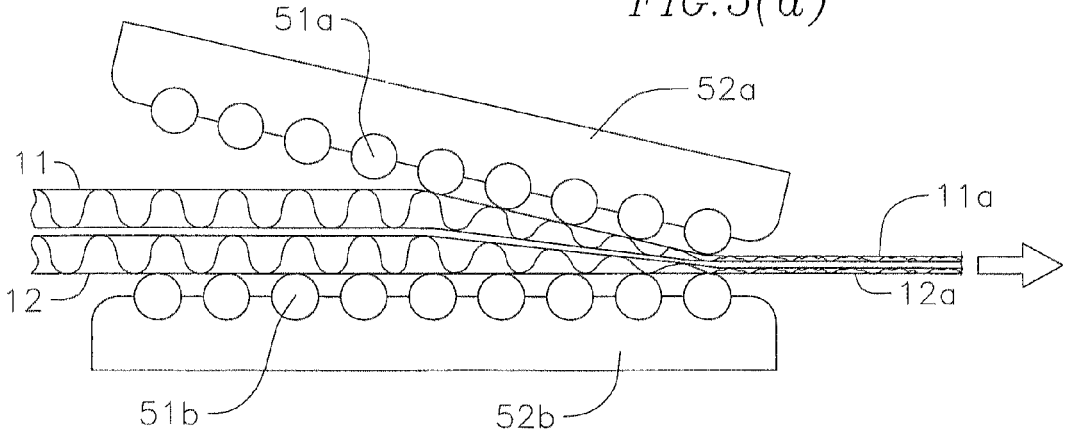

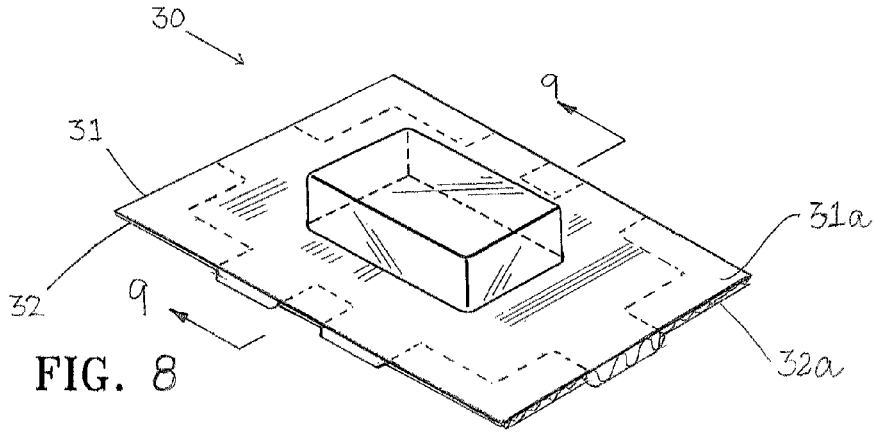
FIG. 8
FIG. 9(a)
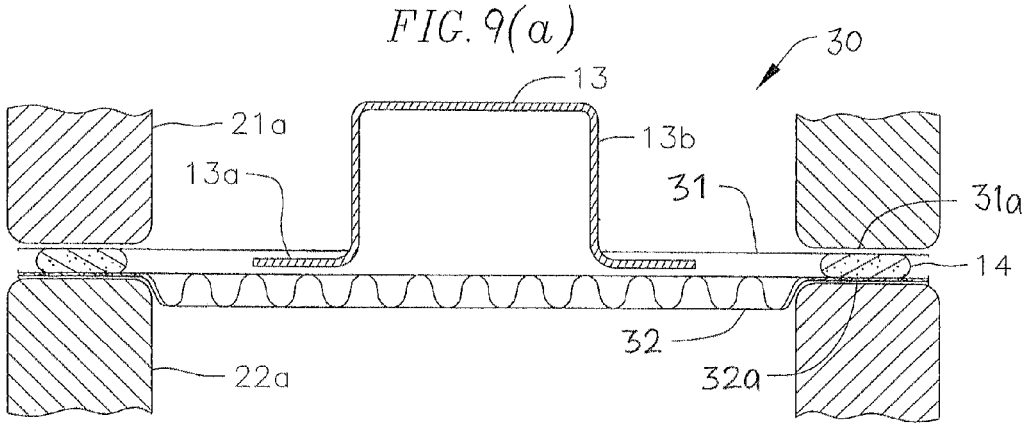
FIG. 9(b)
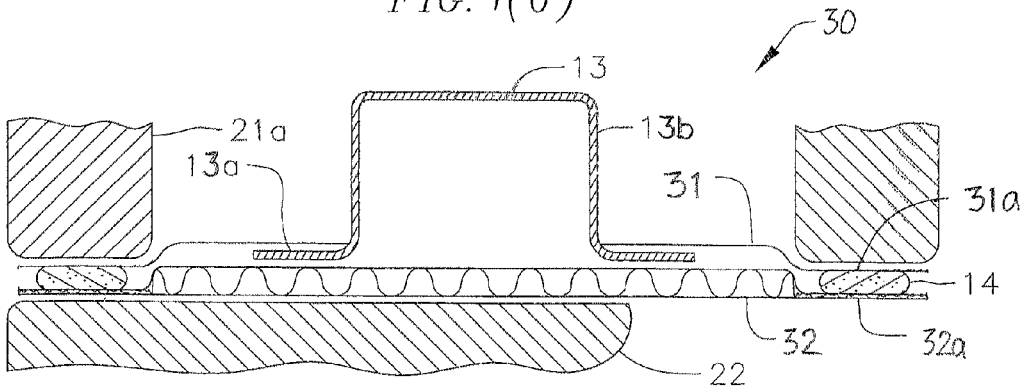

DISPLAY PACK AND PACKAGING METHOD AND APPARATUS

CROSS-REFERENCE TO RELATED APPLICATIONS

This application is a continuation of U.S. patent application Ser. No. 11/374,769, entitled DISPLAY PACK AND PACKAGING METHOD AND APPARATUS, filed Mar. 14, 2006 now U.S. Pat. No. 7,726,480, which claims priority to and the benefit of U.S. provisional application No. 60/711,024, filed Aug. 24, 2005, the entire contents of which are incorporated herein by reference.

BACKGROUND OF THE INVENTION

This invention relates to product packaging, and in particular, it relates to packaging for products suitable for store merchandising.

DESCRIPTION OF THE RELATED ART

A first type of conventional packaging for consumer products, shown in FIGS. 6(*a*) and 6(*b*) (which is a cross-sectional view along the direction of arrows 2-2), is made of two sheets of corrugated cardboard 101 and 102, and a clear plastic container 103 having a flat insertion portion 103*a* and a chamber portion 103*b*. The insertion portion is sandwiched between the two cardboard sheets 101 and 102, and the chamber portion 103*b* protrudes from the plane of the cardboard sheets via a cut (opening) on one cardboard sheet 101 and is used to hold the product inside. A second plastic container 103' may be provided and protrudes from the other cardboard sheet 102 to form a continuous space for hold the product. The two cardboard sheets 101 and 102 are adhered together around the periphery with an adhesive 104. A commonly used adhesive is a hot melt glue. The front and back sides of the package are typically printed with product information and other information. (In these drawings, the spaces between the various layers are exaggerated to illustrate the relationship among the various layers.) One disadvantage of this type of conventional packaging is that the hot melt glue is typically applied by hand, and thus the seal quality is often difficult to control due to, for example, the varying drying speed of the glue, the placement of the glue, etc. Another disadvantage is that the corrugation of the cardboard is visible at some of the side edges of the finished packaging (see FIG. 6(*c*), a view of the bottom edge of the packaging of FIG. 6(*a*)), making the packaging aesthetically unappealing.

A second type of conventional packaging, shown in FIG. 7(*a*), is similar to the first type shown in FIGS. 6(*a*)-(*c*), but uses one sheet of corrugated cardboard 112 (typically the back sheet) and one flat sheet of paper 111 (typically the front sheet, i.e., on the side of the product chamber). Sometimes two flat sheets of paper 111 and 111' are used, one on each side of the corrugated cardboard (see FIG. 7(*b*). The cardboard sheet 112 and the flat paper sheet 111 are adhered together by a heat-sensitive adhesive 114 to seal the package. The heat sensitive adhesive is pre-applied to the cardboard sheet and/or the flat paper sheet, and heat is applied from the paper side, conducted to the adhesive via the paper to activate the adhesive. Heat sensitive adhesives have not been used in the first type of packaging because corrugated cardboard sheets are poor heat conductors, and heat applied to the outer side of the cardboard cannot easily reach the area between the two cardboard sheets where the heat adhesive material would be applied.

A disadvantage of the second type of conventional packaging is that it sometimes lacks sufficient structural strength. Display packs are often transported in an assembly where a plurality of display packs are stood on their sides in a container with half-height walls (i.e. walls not as high as the packs themselves), and wrapped together to form a box-shaped bundle. When two or more of such bundles are stacked on top of each other, the weight of the top one is supported directly by the packs in the bottom bundle. The packs therefore must have sufficient structural strength and rigidity to prevent them from bending. The lack of physical strength also makes it difficult to make larger packages (e.g. larger than 10 by 15 inches), or to pack heavier items.

SUMMARY OF THE INVENTION

Accordingly, the present invention is directed to a display pack and packaging method that substantially obviates one or more of the problems due to limitations and disadvantages of the related art.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a display pack for a product including a first and a second corrugated cardboard sheet, at least one cardboard sheet defining at least one opening; at least one container having a flat insertion portion and a chamber portion for holding the product, the insertion portion being sandwiched between the two cardboard sheets and the chamber portion protruding from a plane of the cardboard sheets via the opening; and an adhesive material between the first and the second cardboard sheets in at least a peripheral area of the two cardboard sheets to join the two cardboard sheets together, wherein the first and second cardboard sheets are crushed in the peripheral area with reduced air gaps in the corrugations. The adhesive material may be a heat-sensitive adhesive material.

In another aspect, the present invention provides a method of making a display pack including the steps of providing a first and a second corrugated cardboard sheet, at least one cardboard sheet defining at least one opening; providing at least one container having a flat insertion portion and a chamber portion for holding the product; placing the insertion portion between the two cardboard sheets so that the chamber portion protrudes from a plane of the cardboard sheets via the opening; applying an adhesive material between the first and second cardboard sheets in a peripheral area of the cardboard sheets; and applying a pressure to the peripheral area of the two cardboard sheets to crush the corrugations inside the cardboard sheets in the peripheral area. The adhesive material may be a heat-sensitive adhesive material, in which case the method further includes applying heat to the heat-sensitive adhesive to activate it.

In another aspect, the present invention provides a device for sealing a display pack, which includes an upper and a lower platen, at least one of the platens having a rim and a recessed central area; and a drive mechanism for driving the platens, the drive mechanism capable of applying a force of 25 tons or more at the platens. The platens may be heated.

The present invention provides another device for sealing a display pack, which includes a transport mechanism for transporting a package; one or more sets of rollers disposed along a path of the transport mechanism, each set of rollers including an upper row and an opposing lower row of rollers, the upper and lower rows of rollers disposed at a tapering angle with respect to each other; and a press for applying a force to at least one of the upper and lower rows of each set of rollers. The device may include two or four sets of rollers. The rollers may be heated.

It is to be understood that both the foregoing general description and the following detailed description are exemplary and explanatory and are intended to provide further explanation of the invention as claimed.

BRIEF DESCRIPTION OF THE DRAWINGS

FIG. 1 is a perspective view illustrating a display pack according to an embodiment of the present invention.

FIGS. 2(*a*) and 2(*b*) schematically illustrate cross-sectional views of the display pack of FIG. 1 along the line 2-2 with platens of a sealing press.

FIG. 3(*b*) is a schematic plan view of a platen of a sealing press according to another embodiment of the present invention.

FIG. 3(*c*) is a schematic cross-sectional view of portions of another sealing press according to another embodiment of the present invention.

FIGS. 4(*a*) and 4(*b*) are schematic cross-sectional views showing portions of a sealing press according to another embodiment of the present invention.

FIGS. 5(*c*) and 5(*d*) schematically illustrate sealer machines employing rollers according to other embodiments of the present invention.

FIG. 8 is a perspective view illustrating a display pack according to an alternate embodiment of the present invention.

FIGS. 9(*a*) and 9(*b*) schematically illustrate cross-sectional views of the display pack of FIG. 8 along line 9-9 with platens of a sealing press.

DETAILED DESCRIPTION OF THE PREFERRED EMBODIMENTS

Figure 6A:
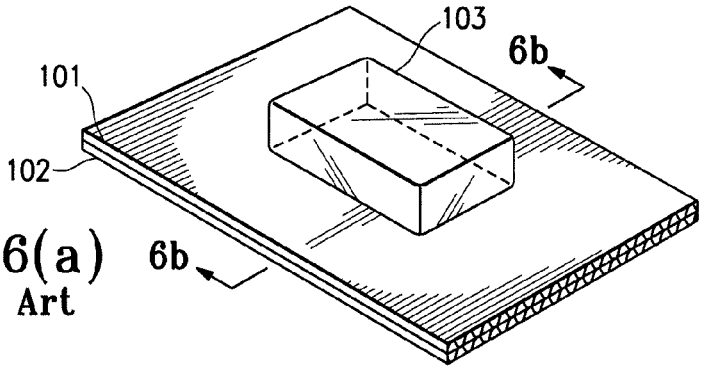
FIG. 6(a) Prior Art
FIGS. 6(*a*)-(*c*) illustrate a package made according to a first conventional packaging technique.
Figure 6B:
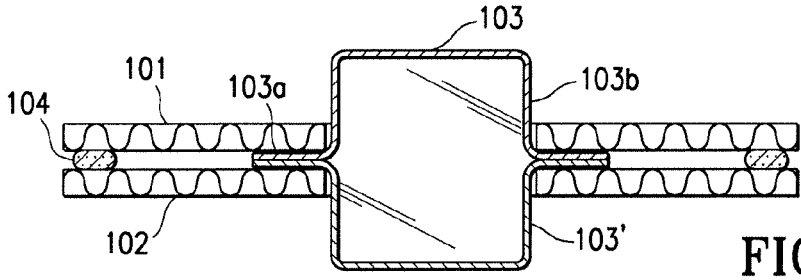
FIG. 6(b) Prior Art
Figure 6C:
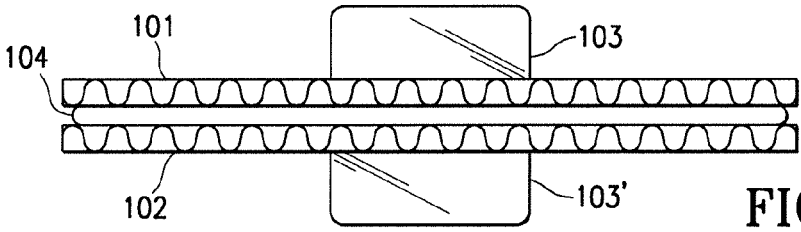
FIG. 6(c) Prior Art

FIG. 1 shows a display pack according to an embodiment of the present invention which has an overall structure similar to that of a conventional packaging shown in FIG. 6(*a*) but is constructed differently. FIGS. 2(*a*) and 2(*b*) are cross-sectional views of the display pack of FIG. 1 along the line 2-2 (the differences between FIGS. 2(*a*) and 2(*b*) will be explained later). As shown in FIGS. 1, 2(*a*) and 2(*b*), the package 1 is made of two sheets of corrugated cardboard 11 and 12 and a plastic container 13 (preferably made of a clear plastic material such as PET) having a flat insertion portion 13*a* and a chamber portion 13*b*. The insertion portion is sandwiched between the two cardboard sheets 11 and 12, and the chamber portion 13*b* protrudes from the plane of the cardboard sheets via a cut on one cardboard sheet 11 and is used to hold the product inside. Although only one is shown in FIGS. 1, 2(*a*) and 2(*b*), a package may contain one or more plastic containers, and they may protrude from either or both of the cardboard sheets and may be located are desired positions depending on the product being held in the package. Further, a plastic container may be a single piece with multiple chambers. The container may be made of a plastic or any other suitable material, and can be of any suitable thickness, color, etc. The front and back sides of the package may be printed with product information and other information. The information may be printed directly on the cardboard, or printed on a litho sheet which is then laminated onto the cardboard. One to six colors can be printed. In FIGS. 2(*a*) and 2(*b*), the corrugations are shown as being parallel to the vertical direction in FIG. 1, which is preferably the vertical direction when the display pack is stood on its side when being displayed or transported. Of course, the corrugation can be in other directions. The corners of the cardboard sheets may be square, rounded, or a combination of both. The two corrugated cardboard sheets 11 and 12 are adhered together at the periphery of the package by a heat-sensitive adhesive 14 to seal the package. The heat-sensitive adhesive is preferably pre-applied to the inner sides of one or (preferably) both cardboard sheets 11 and 12 prior to the sealing operation, but it may also be applied during the sealing operation. The adhesive may be applied to the entire sheet, or a periphery, or any desired areas of the sheet. In one embodiment, the cardboard sheets 11 and 12 are formed of one cardboard sheet folded over, the cardboard sheet being pre-coated with an adhesive on the entire surface.

To seal the package, the peripheral areas 11*a*, 12*a* of the two overlaying cardboard sheets are subject to a sufficient amount of pressure to crush the corrugations inside the cardboard sheets and flatten them in that area. Heat is applied, either simultaneously with or subsequent to the application of pressure, to the outer side of either one or both cardboard sheets in the peripheral area. Because the corrugations inside the cardboard are crushed and the air gaps are substantially eliminated, the crushed cardboard becomes a better heat conductor. Sufficient heat can be conducted from the outer side to the inner side where the heat-sensitive adhesive has been applied to activate the adhesive and seal the package. In one preferred embodiment, the width of the crushed peripheral areas is approximately 0.5 inches. Any suitable sealing width may be used, but it is desirable that the adhesive not be adhered to the insertion portion of the container, so that the container can be easily removed from the packaging for recycling. This is desirable because it facilitates recycling of the container. In addition, the container may be made as a reusable container, and easy removal may facilitate re-use in such a case.

Figure 3A:
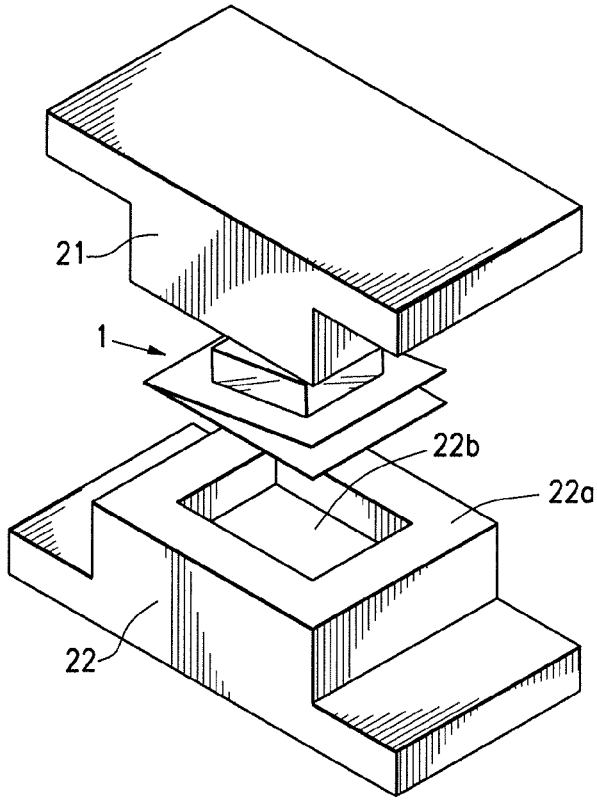
FIG. 3(*a*) schematically illustrates parts of a sealing press used to seal a package according to an embodiment of the present invention.
Figure 3B:
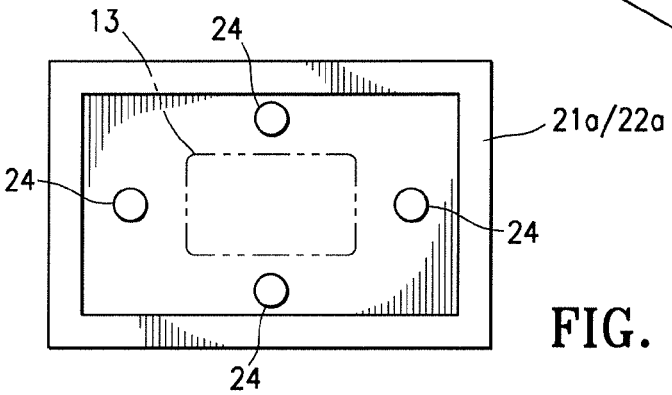
Figure 3C:
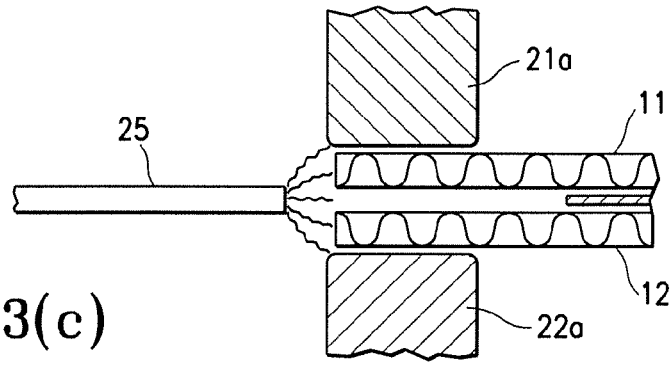

Many types of sealer machines may be used to carry out the sealing process, some of which are described below. The first is a sealer machine with a heated sealing press. As shown in FIG. 3(*a*) (perspective view), the sealing press has an upper platen 21 and a lower platen 22. The lower platen 22 is show to have a rim 22*a* with a heated surface, a recessed central portion 23 that may accommodate the protrusions 13*b* of the package being sealed. The upper platen 21 similarly has a heated rim 21*a* and a recessed central portion (not shown). The rims have a width determined by the desired width of the crushed peripheral areas of the finished package. Alternative configurations of the sealing press may be used. For example, one of the platens may have a flat surface without a recess, or have a rim wider than the rim of the other platen. If both the upper and lower platens have rims of similar widths, the crushed peripheral areas of the cardboard sheets may appear depressed on both sides (see FIG. 2(*a*)). If one platen is flat or has a rim wider than the rim of the other platen, the crushed peripheral areas of the cardboard sheets may appear depressed only on the side of the narrower rim (see FIG. 2(*b*)). In the platen configuration of FIG. 2(*a*), one or both rim portions 21*a* and 22*a* may be heated. In the configuration of FIG. 2(*b*), preferably only the narrower rim 21*a* is heated because it may be undesirable for areas other than the sealed peripheral areas to be heated. Heating from both sides may be more desirable as it reduces the heating time and speeds up the sealing operation.

Preferably, the force or pressure applied by the platens is such that the cardboard sheets are crushed to up to approximately 50% of their original thickness. Generally speaking, within certain limits, higher pressure results in thinner crushed cardboard sheets, which in turn results in increased heat transfer rate and therefore reduced heat application time required to properly activate the adhesive. The optimum pressure may also depend on the type of the cardboard used. The temperature of the heated surface may be approximately from 100 to 500 degrees F., which is a typical temperature used in the second conventional packaging technique. Those of ordinary skill in the art will be able to find acceptable or optimum pressure, temperature and process time conditions for the particular cardboard used without undue experimentation.

In one particular example, the package uses two sheets of 200 lb test E-flute cardboard coated with a heat sensitive blister card coating as an adhesive, has a size of 10 inches by 15 inches and a sealed width of 0.5 inches. The sealing press has a rim on both platens and both surfaces are heated to a temperature of 300 degrees F. The force on the platens is 25 tons. The pressure and heat was applied simultaneously for 3 seconds.

Figure 7A:
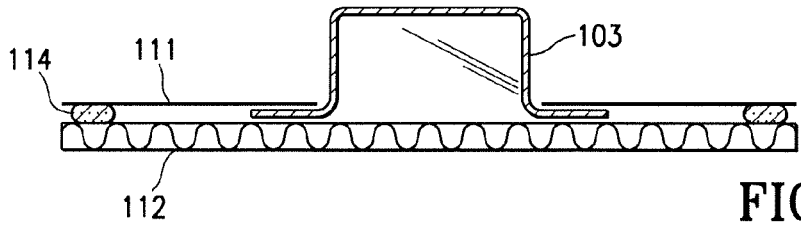
FIG. 7(a) Prior Art
FIGS. 7(*a*) and 7(*b*) illustrate a package made according to a second conventional packaging technique.
Figure 7B:
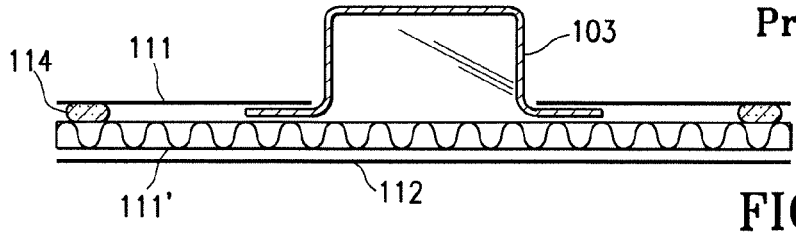
FIG. 7(b) Prior Art

The sealer machine suitable for the above application may be a machined used to seal a conventional package of the second type (as shown in FIG. 7(*a*)), modified so that the platens can apply sufficient pressures to crush the cardboard. The machine has a pneumatically driven upper and lower toggle mechanism to create the pressure. There are four hydraulic units located under four lower posts which are used as an additional means of raising the press to maximize the pressure. The force on the platens is adjustable. In one example, the force is approximately between 10 and 75 tons. The upper and lower seal heat is generated with the use of multiple cartridge heaters controlled through solid state relays. The temperature of the upper surface is adjustable from 0 to 450 degrees F.; the temperature of the lower surface is fixed at 450 degrees F. Additionally, there are chain driven elevators used to move the fixture that holds the packages during assembly and sealing back to the initial start position.

In addition to the peripheral areas, the corrugated cardboards 11 and 12 may be crushed and sealed in certain interior areas (spot sealed) to provide additional security, especially for larger packages and packages with multiple separate plastic containers. To achieve spot sealing, as shown in FIG. 3(*b*) (plan view of a platen), a sealer press is provided with a number of posts 24 inside the area surrounded by the rim portion 21*a* and/or 22*a*. Opposing posts are provided if both platens have a recessed central portion; alternatively, if one platen is flat, the other platen is provided with the posts 24. The posts are pressured and heated in the same way as the rim portion.

A second type of sealer machine useful for carrying out the sealing process is a sealing press similar to the one described above, but instead of heated platen(s), hot air or a hot steam is applied to the heat-sensitive adhesive to heat it. The hot air or steam is supplied from the side by a tube or pipe 25 as shown in FIG. 3(*c*) (cross-sectional view). Since a corrugated cardboard typically contains an adhesive to hold its various layers together, it is possible that the hot air or hot steam will melt this adhesive. Thus, after crushing, the layers of the crushed corrugated board will be adhered together by this adhesive, resulting in increased structural integrity of the seal. As an alternative, heated platen(s) and hot air/hot steam may be used in combination.

FIGS. 4(*a*) and 4(*b*) illustrate an alternative embodiment of the sealing press (either heated or unheated). In this embodiment, the platens are similar to those shown in FIGS. 2(*a*), 2(*b*), 3(*a*) and 3(*c*), but the rim portions 21*a* and 22*a* have rounded or chamfered edges 21*b* and 22*b* on the inside edges, i.e. the edges that correspond to the border between the crushed and uncrushed portions of the package. The rounded shape of the edges 21*b* and 22*b* avoids forming a sharp line between the crushed and uncrushed portions on the package and avoids potentially tearing or cutting the surface sheet of the cardboard. Desirable radius of the rounded edges 21*b* and 22*b* depends on the thickness of the corrugated boards, and is preferable about ⅛ to 1 inch. Note that FIGS. 4(*a*) and 4(*b*) illustrate the stage of the platens before crushing occurs.

Figure 5B:
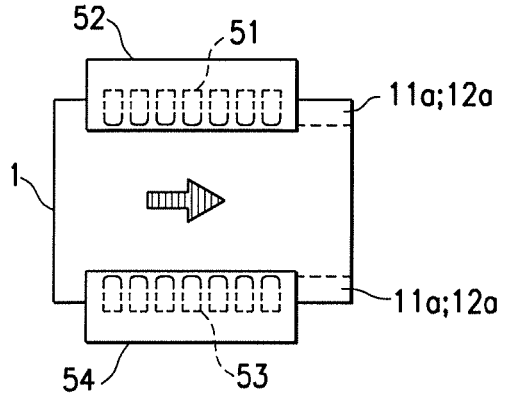
FIGS. 5(*a*) and 5(*b*) are schematic cross-sectional views showing rollers of a sealer machine according to another embodiment of the present invention.
Figure 5C:
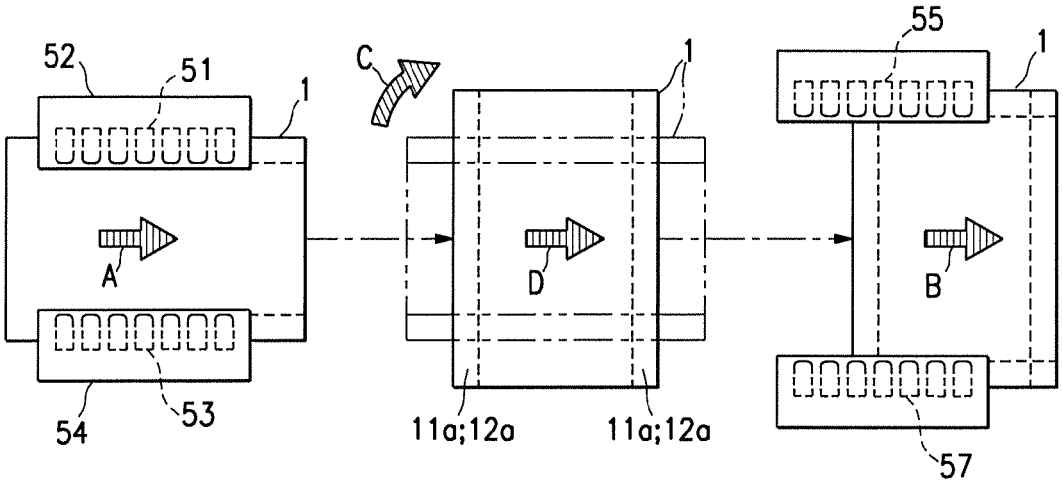
Figure 5D:
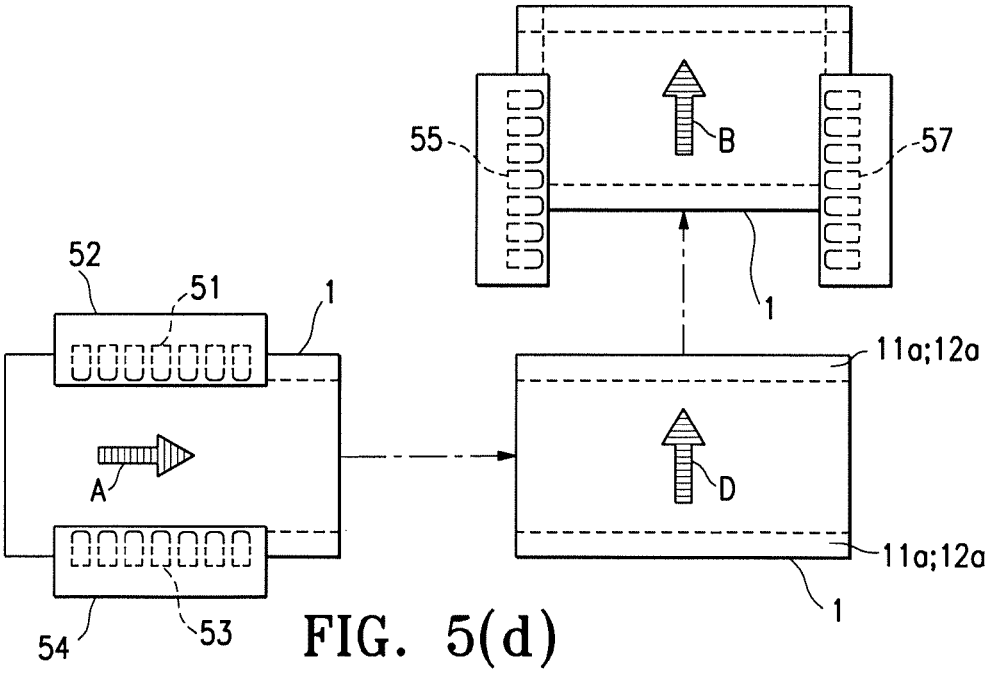

A third type of sealer machine according to an embodiment of the present invention is shown in FIGS. 5(*a*)-(*d*). Instead of a press, parallel sets of rollers are used to seal the package in this type of machine. FIG. 5(*a*) is a schematic cross sectional view along a side of a package to illustrate the side being sealed by a set of rollers of the sealer machine. The package contains two sheets of corrugated cardboard 11 and 12 with an adhesive (not shown) applied between the two sheets in the peripheral areas. The set of rollers of the sealer machine has opposing upper and lower rows of rollers 51*a* and 51*b* mounted on respective roller blocks 52*a* and 52*b*. The upper and lower rows of rollers 51*a* and 51*b* are disposed at a tapering angle relative to each other such that gap between opposing rollers is slightly greater than the thickness of two sheets of uncrushed corrugated cardboard at the entrance end (the left hand side in FIG. 5(*a*)), and is reduced to the desired thickness of the two sheets of crushed corrugated cardboard at the exit end. The angle and the gap are preferably adjustable. FIG. 5(*a*) shows the lower row of rollers 51*b* as being horizontal, but other designs are possible; for example, the upper row of rollers 51*a* may be horizontal or neither row may be horizontal. Alternatively, a front segment of the two rows of rollers may be disposed at a tapering angle and a back segment thereof are disposed in parallel with a gap equal to the thickness of the crushed corrugated cardboard sheets. Sufficient pressure is applied to the roller blocks to crush the corrugations in the cardboard sheets and to seal the package. In one embodiment, the upper roller block 52*a* is fixed and the lower roller block 52*b* is mounted on a hydraulic press capable of applying a force of about 0 to 75 tons, preferably about 20 to 70 tons. The force is preferably adjustable. One or both rows of rollers may be heated to a controllable temperature in a similar manner as the temperature control mechanism for the sealing press described earlier.

Similar to the platens shown in FIGS. 4(*a*) and 4(*b*), the rollers 51*a* and 51*b* may have rounded to chamfered inside edges to avoid potentially tearing or cutting the surface sheet of the cardboard.

FIG. 5(*b*) is a schematic top plan view showing a parallel pair of roller sets 51*a,b* (collectively 51) and 53 mounted on a pair of roller blocks 52*a,b* (collectively 52) and 54 as well as a package 1 passing through the pair of roller sets. The structures of the roller set 53 and the roller block 54 are similar to those of the roller set 51 and the roller block 52. The lateral distance between the two roller sets 51 and 53 is adjustable to seal packages of different widths. The two roller sets 51 and 53 may be independent rollers; or alternatively, the lower rows of rollers in the roller sets 51 and 53 may be the same rollers that extend across the width of the package. In the latter case, only the distance between the upper rows of rollers will be adjusted for different package widths.

The pair of roller sets shown in FIG. 5(*b*) can seal two parallel sides of a package. To seal the other two parallel sides, the package may be passed through another, similar sealer machine, or though the same pair of roller sets one more time (after adjusting the distance if necessary), or through an additional pair of roller sets of the same sealer machine. FIGS. 5(*c*) and 5(*d*) show two preferred sealer machines each having two pairs of roller sets. In the machine shown in FIG. 5(*c*), a second pair of roller sets 55, 57 is provided downstream of and at the same orientation as the first pair of roller sets 51, 53. The package 1 is first transported by a transport mechanism in a first direction as indicated by the arrow A and sealed on two sides by the first pair of roller sets 51, 53. Then, the package is rotated 90 degrees (as indicated by the arrow C) by a rotation mechanism and continues to move in the same direction (as indicated by the arrow D). It then passes through the second pair of roller sets 55, 57 (as indicated by the arrow B) and is sealed on the other two sides. In the machine shown in FIG. 5(*d*), a second pair of roller sets 55, 57 is provided at a right angle with respect to the first pair of roller sets 51, 53. The package 1 is first transported in a first direction (as indicated by the arrow A) and sealed on two sides by the first pair of roller sets 51, 53, and then, without changing its orientation, is transported in a second direction (as indicated by the arrow B) at a right angle to the first direction. It then passes through the second pair of roller sets 55, 57 (as indicated by the arrow B) and is sealed on the other two sides. In the machines shown in FIGS. 5(*c*) and 5(*d*), the distances between the roller sets 51 and 53, and 55 and 57 in the first and second pair of roller sets are adjusted for the two widths of the package, respectively. The structures of the transport mechanism, the rotation mechanism and the mechanism for adjusting the distance between roller sets are not described in detail here as they are within the level of skill of artisans in the mechanical art.

The package in FIG. 1 is shown to be sealed with the adhesive on all four sides. Alternatively, instead of sealing around the entire periphery with the heat-sensitive adhesive, the package may be sealed in selected peripheral areas only. In particular, the two cardboard sheets 11 and 12 may be made of one board and folded once in the middle, and the side of the package corresponding to the fold line may not need to be sealed with the adhesive (although it is preferable to seal it as well). In such cases, the platens of the sealing press may be constructed so that heat and pressure are only applied to the areas where seals are to be formed.

The package 30 in FIG. 8 uses one sheet of corrugated cardboard 31 and one flat sheet of paper 32, and may be sealed in at least one peripheral area 31*a*, 32*a*.

The packaging technique according to embodiments of the present invention has the following advantages. The packages are more secure and harder to tear from the edge and the center than packages made by the first conventional method described above which uses hot melt glue. The sealing quality is also more consistent than seals using glue because the drying (cooling) speed and the placement of the hot melt glue are hard to control. Packages made with the present technique are also aesthetically more appealing than packages made by the first and second conventional techniques in that the corrugations of the cardboard sheets are less visible when viewed from the side edges (e.g. the bottom side) due to the crushing. Compared to the second conventional packaging technique, packaging made with the present method is stronger because it uses two cardboard sheets. As a result, the packages can be made larger and to pack heavier items, and multiple packages can be stacked in bundles. For example, the packages can be as large as 24×24 inches (whereas the second conventional type of packages are typically up to 14×14 inches) and can be used to pack items as heavy as 10 to 20 lbs. Also, the second type of conventional packages have a tendency to warp because the two sheets are of different materials. Packages according to the present invention are also more environmentally friendly because unlike the cardboard used in the present technique, the flat sheet of paper used in the conventional method uses less post-consumer recycled material. The present sealing technique is also faster than the process used in the second conventional technique.

Although the above-described embodiments are most advantageous when used in combination with a heat-sensitive adhesive, the crushing technique described above may also be applied when a regular, non-heat-sensitive adhesive is used. Such a package has the advantages that it is harder to open and tear from the edge than packages made by the first conventional method described above because the corrugations is crushed in the edge areas. It is also aesthetically more appealing than packages made by the first and second conventional techniques in that the corrugations of the cardboard sheets are less visible when viewed from the side edges due to the crushing.

It will be apparent to those skilled in the art that various modification and variations can be made in the display pack and packaging method of the present invention without departing from the spirit or scope of the invention. Thus, it is intended that the present invention cover modifications and variations that come within the scope of the appended claims and their equivalents.

I claim:

1. A display pack for a product, comprising:

a corrugated cardboard sheet and a flat sheet of paper overlaying each other in a stacked configuration, the cardboard sheet having an upper facing, a lower facing and an inner corrugated member with corrugations defining air gaps between the upper and lower facings, the stacked configuration having an outer peripheral edge and an original thickness, the paper sheet defining at least one opening;

at least one container having a flat insertion portion and a chamber portion for holding the product, the insertion portion being sandwiched between the cardboard sheet and the paper sheet and the chamber portion protruding from a plane of the stacked configuration via the opening, the stacked configuration having an inner portion extending around the opening and covering the insertion portion, and at least one peripheral area extending from the inner portion to and including at least a segment of the outer peripheral edge; and an adhesive between the corrugated cardboard sheet and the paper sheet in at least a portion of the peripheral area to adhere the corrugated cardboard sheet and the flat sheet, wherein the inner portion has substantially the original thickness, and the at least one peripheral area of the stacked configuration having a portion of the upper facing, the inner corrugated member, and the lower facing is crushed with reduced air gaps therein to a thickness up to approximately 50% of the original thickness.

2. The display pack of claim 1, wherein the adhesive is a heat-sensitive adhesive material.

3. The display pack of claim 1, wherein the container is made of a clear plastic material.

4. The display pack of claim 1, wherein the corrugations in the corrugated cardboard sheet are parallel to a vertical direction when the display pack is stood on its side when being displayed or transported.

5. A display pack of claim 1, wherein the display pack is generally rectangular and the outer peripheral edge includes four generally straight edge portions, wherein the at least one peripheral area extends from a different portion of the outer peripheral edge to an inner boundary that is generally parallel to the outer peripheral edge, and wherein at least one peripheral area is crushed with reduced air gaps therein to a thickness up to approximately 50% of the original thickness.

6. A display pack of claim 1, wherein the display pack is generally rectangular and the outer peripheral edge includes four generally straight edge portions, wherein the stacked configuration has four peripheral areas, each extending from a different segment of the outer peripheral edge to the inner boundary that is generally parallel to the outer peripheral edge, and wherein at least one of the four peripheral areas is crushed with reduced air gaps therein to a thickness up to approximately 50% of the original thickness.

7. A display pack of claim 6 wherein at least two of the peripheral areas are crushed with reduced air gaps therein to a thickness up to approximately 50% of the original thickness.

8. A display pack of claim 6 wherein at least three of the peripheral areas are crushed with reduced air gaps therein to a thickness up to approximately 50% of the original thickness.

9. A display pack of claim 6 wherein at least four of the peripheral areas are crushed with reduced air gaps therein to a thickness up to approximately 50% of the original thickness.

10. A display pack for a product, comprising:

upper and lower sheets overlaying each other, the lower sheet comprising a corrugated cardboard sheet having an upper facing, a lower facing and an inner corrugated member with corrugations and air gaps between the upper and lower facings, the upper sheet comprising a flat sheet of paper, the two sheets forming a layered structure having an original thickness and an outer peripheral edge, the upper sheet defining at least one opening;

at least one container having a flat insertion portion and a chamber portion for holding the product, the insertion portion having an outer edge and being sandwiched between the upper and lower sheets and the chamber portion protruding from a plane of layered structure via the opening, the layered structure having at least one peripheral area extending inwardly from the outer peripheral edge to an inner boundary and an inner area between the inner boundary and the opening; and an adhesive between the two sheets in the at least one peripheral area to adhere the two sheets;

wherein the inner area has substantially the original thickness and the at least one peripheral area includes at least one crushed area in which the corrugations are flattened with reduced air gaps therein to a thickness less than the original thickness.

11. A display pack of claim 10, wherein the air gaps in the at least one crushed area are substantially eliminated.

12. A display pack of claim 10, wherein the thickness of the at least one crushed area is no more than about 50% of the original thickness.

13. A display pack of claim 10, having in the at least one crushed area a generally flat depressed area on an outer surface of at least one of the upper and lower sheets.

14. A display pack of claim 13, wherein the depressed area is only on an outer surface of the lower sheet.

15. A display pack of claim 13, wherein the depressed area is only on an outer surface of the upper sheet.

16. A display pack of claim 10, having in the at least one crushed area a first depressed area on the outer surface of the lower sheet and a second depressed area on the outer surface of the upper sheet.

17. A display pack for a product, comprising:

a corrugated cardboard sheet and a flat sheet of paper overlaying each other in a stacked configuration, the cardboard sheet having an upper facing, a lower facing and an inner corrugated member with corrugations and air gaps between the upper and lower facings, the stacked configuration having front and back outer surfaces and an outer peripheral edge, the cardboard sheet having an original thickness, the cardboard sheet defining at least one opening;

at least one container having a flat insertion portion and a chamber portion for holding the product, the insertion portion being sandwiched between the cardboard sheet and the flat sheet and the chamber portion protruding from a plane of the stacked configuration via the opening, the stacked configuration having an inner portion extending around the opening and covering the insertion portion, and at least one peripheral area extending from the inner portion to and including at least a segment of the outer peripheral edge, the inner portion of the stacked configuration comprising an inner portion of the cardboard sheet, the at least one peripheral area of the stacked configuration having a peripheral portion of the cardboard sheet; and an adhesive between the corrugated cardboard sheet and the flat sheet in at least a portion of the at least one peripheral area to adhere the corrugated cardboard sheet and the flat sheet, wherein the inner portion of the cardboard sheet has substantially the original thickness, and the peripheral portion of the cardboard sheet having a portion of the upper facing, the inner corrugated member, and the lower facing is crushed such that the air gaps therein are substantially eliminated to thereby form a generally flat depressed area on at least one of the front and back outer surfaces of the display pack.

18. A display pack of claim 17, wherein the depressed area is only on the front outer surface of the display pack.

19. A display pack of claim 17, wherein the depressed area is only on the back outer surface of the display pack.

20. A display pack of claim 17, having a first depressed area on the first outer surface and a second depressed area on the second outer surface.

* * * * *

US008205747C1

(12) INTER PARTES REEXAMINATION CERTIFICATE (1059th)

United States Patent

Nazari

(10) Number: US 8,205,747 C1

(45) Certificate Issued: *Mar. 3, 2015

(54) DISPLAY PACK AND PACKAGING METHOD AND APPARATUS

(75) Inventor: Joseph Nazari, Glendale, CA (US)

(73) Assignee: Winterborne, Inc., Chatsworth, CA (US)

Reexamination Request:
No. 95/002,352, Sep. 14, 2012

Reexamination Certificate for:

| | |
|---|---|
| Patent No.: | **8,205,747** |
| Issued: | **Jun. 26, 2012** |
| Appl. No.: | **12/790,747** |
| Filed: | **May 28, 2010** |

( * ) Notice: This patent is subject to a terminal disclaimer.

Related U.S. Application Data

(63) Continuation of application No. 11/374,769, filed on Mar. 14, 2006, now Pat. No. 7,726,480.

(60) Provisional application No. 60/711,024, filed on Aug. 24, 2005.

(51) Int. Cl.

| | |
|---|---|
| ***B65D 81/24*** | (2006.01) |
| ***B65D 73/00*** | (2006.01) |
| ***B65B 51/14*** | (2006.01) |

(52) U.S. Cl.

CPC ..... *B65D 73/0092* (2013.01); *B65B 51/14* (2013.01)

USPC ..... 206/461; 206/462

(58) Field of Classification Search

None

See application file for complete search history.

(56) References Cited

To view the complete listing of prior art documents cited during the proceeding for Reexamination Control Number 95/002,352, please refer to the USPTO's public Patent Application Information Retrieval (PAIR) system under the Display References tab.

*Primary Examiner* — Robert M Fetsuga

(57) ABSTRACT

A display pack for a consumer product is made of two sheets of corrugated cardboard and a clear plastic container with a flat insertion portion sandwiched between the cardboard sheets. The two cardboard sheets are adhered together in a peripheral area of the package by a heat-sensitive adhesive, and the corrugations of the cardboard sheets are crushed and flattened in the peripheral area. To seal the package, the peripheral area of the two cardboard sheets is subject to sufficient pressure to crush the corrugations inside the cardboard sheets and flatten them in that area. Heat is applied to the outer side of the cardboard sheets in the peripheral area and conducted to the adhesive material between the two sheets to activate the adhesive material. A sealer machine with a heated sealing press or parallel sets of heated rollers may be used to carry out the sealing process.

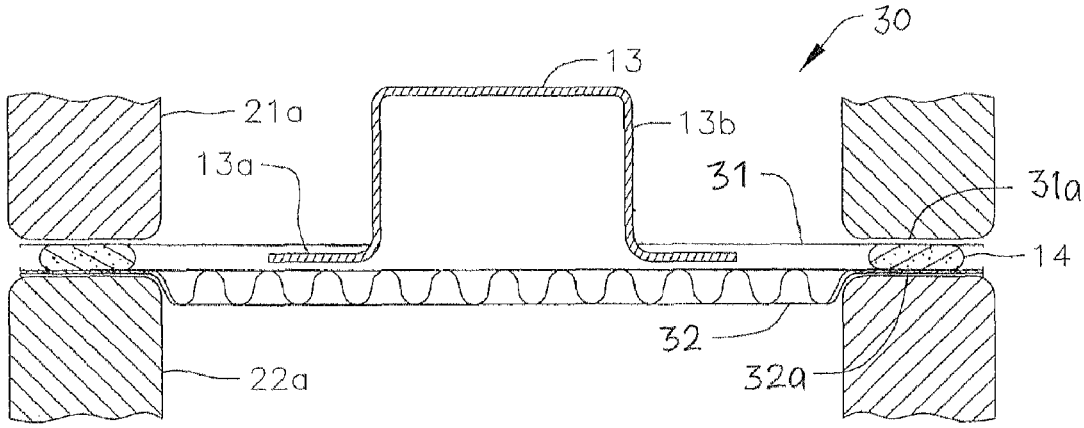

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-20 are cancelled.

* * * * *